US012789108B2

(12) United States Patent
Li

(10) Patent No.: US 12,789,108 B2
(45) Date of Patent: Nov. 10, 2026

(54) ACTIVITY CENTER STRUCTURE FOR A CHILD

(71) Applicant: DONGGUAN JINWANG CHILDREN PRODUCTS CO. LTD., Dongguan (CN)

(72) Inventor: Wei Li, Dongguan (CN)

(73) Assignee: DONGGUAN JINWANG CHILDREN PRODUCTS CO. LTD., Dongguan (CN)

( * ) Notice: Subject to any disclaimer, the term of this patent is extended or adjusted under 35 U.S.C. 154(b) by 342 days.

(21) Appl. No.: 18/399,733

(22) Filed: Dec. 29, 2023

(65) Prior Publication Data

US 2024/0207752 A1 Jun. 27, 2024

Related U.S. Application Data

(63) Continuation of application No. PCT/CN2022/101548, filed on Jun. 27, 2022.

(30) Foreign Application Priority Data

Jun. 29, 2021 (CN) ..... 202121466684.6

(51) Int. Cl.
*A63H 33/00* (2006.01)

(52) U.S. Cl.
CPC ..... *A63H 33/006* (2013.01)

(58) Field of Classification Search
CPC ..... A47B 83/02; A47D 3/001; A63H 33/006
See application file for complete search history.

(56) References Cited

U.S. PATENT DOCUMENTS 5,433,682 A * 7/1995 Fermaglich ..... A47D 13/043 297/344.21
5,728,030 A * 3/1998 Hsieh ..... A47D 13/043 482/54

(Continued)

FOREIGN PATENT DOCUMENTS

CN 210300373 U 4/2020
CN 212395699 U 1/2021

(Continued)

OTHER PUBLICATIONS

International Search Report dated Sep. 8, 2022 in International Application No. PCT/CN2022/101548. English translation attached.

(Continued)

*Primary Examiner* — Michael D Dennis
*Assistant Examiner* — Matthew B Stanczak

(57) ABSTRACT

The present disclosure discloses an activity center structure for a child. The structure includes an activity center frame, a support bottom frame, a support leg, and an elastic surface having elasticity. The activity center frame is located above the support bottom frame, and provided with a seat pocket for placing the child at a middle part of the activity center frame. The support leg is connected between the activity center frame and the support bottom frame. The support bottom frame has a mounting position where the support bottom frame is hollow. The mounting position at least corresponds to a position where the seat pocket is located. The elastic surface is mounted at the mounting position to allow the child placed in the seat pocket to step on the elastic surface. In this way, the activity center structure has better safety performance.

8 Claims, 7 Drawing Sheets

(56) References Cited

U.S. PATENT DOCUMENTS

| | | | | |
|---|---|---|---|---|
| 7,740,560 | B2 * | 6/2010 | Tadin | A47D 3/001 482/27 |
| 8,186,282 | B1 * | 5/2012 | Sinchok | A47B 13/021 108/147.12 |
| 8,944,514 | B2 * | 2/2015 | Tadin | A47D 1/0081 297/219.12 |
| 10,342,361 | B2 * | 7/2019 | Cotirla | A63H 33/006 |
| 10,456,701 | B2 * | 10/2019 | Healy | A47D 11/002 |
| 10,945,535 | B2 * | 3/2021 | Roberts | A47D 11/00 |
| D945,533 | S * | 3/2022 | Liang | D12/130 |
| 2002/0027382 | A1 * | 3/2002 | Bellows | A63H 33/006 297/135 |
| 2002/0164917 | A1 * | 11/2002 | Keegan | A47D 13/043 297/1 |
| 2005/0221715 | A1 * | 10/2005 | Fair | A63H 33/006 446/227 |
| 2007/0236056 | A1 * | 10/2007 | Steininger | A63H 33/006 297/136 |
| 2008/0113581 | A1 * | 5/2008 | Jazenski | A63H 33/006 297/136 |
| 2017/0232355 | A1 * | 8/2017 | Healy | A47D 3/001 446/227 |
| 2018/0177347 | A1 * | 6/2018 | Batiste | A47K 3/127 |
| 2018/0297623 | A1 * | 10/2018 | Burns | A47D 13/107 |
| 2018/0317668 | A1 * | 11/2018 | Cotirla | A47D 11/002 |
| 2020/0397146 | A1 * | 12/2020 | Lodato | A47D 3/001 |
| 2021/0361078 | A1 * | 11/2021 | Logan | A47D 11/002 |
| 2024/0207752 | A1 * | 6/2024 | Li | A63H 33/006 |

FOREIGN PATENT DOCUMENTS

| | | |
|---|---|---|
| CN | 213046287 U | 4/2021 |
| CN | 215423792 U | 1/2022 |

OTHER PUBLICATIONS

First Office Action dated Jan. 24, 2025 received in corresponding patent family application No. AU202230221924.

* cited by examiner

ACTIVITY CENTER STRUCTURE FOR A CHILD

CROSS-REFERENCE TO RELATED APPLICATION

This application is a continuation of International Application No. PCT/CN2022/101548, filed on Jun. 27, 2022, which claims priority to Chinese Patent Application No. 202121466684.6 (filed on Jun. 29, 2021), the entire contents of which are incorporated herein by reference.

FIELD

The present disclosure relates to the field of children products technologies, and more particularly, to an activity center structure for a child.

BACKGROUND

An activity center for a child is a children's activity appliance used for children to play or assist in exercising children to stand.

In the related art, the activity center for the child is provided with a table frame, a table frame supporting plate, and a standing plate. The table frame is mounted at the table frame supporting plate. The standing plate is connected to the table frame through a connecting belt and located above the table frame supporting plate. When the child steps on the standing plate, the connecting belt is easy to shake, and the standing plate cannot be kept stable, which is easy to cause harm to the child.

In view of the above problems, the activity center for the child needs to be improved.

SUMMARY

The present disclosure aims to overcome shortcomings of the related art and provide a stable and safe activity center structure for a child.

According to technical solutions of the present disclosure, the activity center structure for the child is provided. The activity center structure includes an activity center frame, a support bottom frame, a support leg, and an elastic surface having elasticity. The activity center frame is located above the support bottom frame, and provided with a seat pocket for placing the child at a middle part of the activity center frame. The support leg is connected between the activity center frame and the support bottom frame. The support bottom frame has a mounting position where the support bottom frame is hollow. The mounting position at least corresponds to a position where the seat pocket is located. The elastic surface is mounted at the mounting position to allow the child placed in the seat pocket to step on the elastic surface. In this way, better safety performance of the activity center structure can be achieved and a possibility of side rollover is reduced when the child steps on the structure.

Further, the elastic surface includes a panel frame and an elastic plate. The panel frame is connected to the mounting position, and the elastic plate is connected to the panel frame. The panel frame defines a position where the elastic plate is located, which improves stability of the elastic plate in a horizontal direction.

Further, the elastic plate is detachably connected to the panel frame, which is easy to mount and replace.

Further, the panel frame includes a frame bottom plate. The elastic plate is arranged above and spaced apart from the frame bottom plate. A bottom of the frame bottom plate is connected to rollers. The rollers reduce friction with the ground and facilitate a movement of the activity center structure.

Further, the support leg is slidably connected to the support bottom frame in a longitudinal direction, and the support bottom frame is connected to a locking member that is slidable in a transverse direction. The support leg has a plurality of insertion slots arranged at intervals and configured to be engaged with the locking member. The locking member is inserted into one of the plurality of insertion slots when the support leg is locked by the locking member. In this way, a height of the activity center frame can be adjusted to suit children of different heights.

Further, each of the plurality of insertion slots internally has a protrusion, and the locking member has a groove opened towards the protrusion. The protrusion is positioned in the groove when the locking member is inserted into the insertion slot. In this way, the locking member can be firmly connected to the insertion slot and not to shake easily.

Further, the support bottom frame has a communication hole. The locking member has a shifting recess configured to operate the locking member to slide. The shifting recess is communication with the communication hole. In this way, it easy to observe a position of the locking member.

Further, the shifting recess internally has an operation block at least partially located in the communication hole. The operation block is slidably connected at the communication hole. In this way, a sliding of the locking member is conveniently operated through the operation block.

Further, the support bottom frame is provided with a stop plate, and an elastic reset member configured to reset the locking member is connected between the locking member and the stop plate. The elastic reset member is connected to the locking member and is capable of abutting with the stop plate. The elastic reset member enables the locking member to reset automatically, which allows that an operation of the activity center structure is simpler and more convenient.

Further, the elastic reset member is an elastic strip of an arc shape. In this way, the structure is simple and the production cost is low.

After adopting the above technical solutions, the present disclosure has following beneficial effects.

According to the present disclosure, the activity center structure for the child includes an activity center frame, a support bottom frame, a support leg, and an elastic surface having elasticity. The activity center frame is located above the support bottom frame, and provided with a seat pocket for placing the child at a middle part of the activity center frame, and the support leg is connected between the activity center frame and the support bottom frame. The support bottom frame has a mounting position where the support bottom frame is hollow. The mounting position at least corresponds to a position where the seat pocket is located. The elastic surface is mounted at the mounting position. In this way, the activity center structure for the child has the good safety performance. When a child steps on the elastic surface, the elastic surface is limited by the support bottom frame and the support leg, and can only deform in an up and down direction, thereby reducing the possibility of side rollover for a child and being beneficial to protecting the child.

BRIEF DESCRIPTION OF THE DRAWINGS

The disclosure of the present disclosure will become more understandable with reference to the accompanying drawings. It should be understood that the drawings are for an illustrative purpose only and are not intended to limit the protection scope of the present disclosure, in which.

Figure 1:
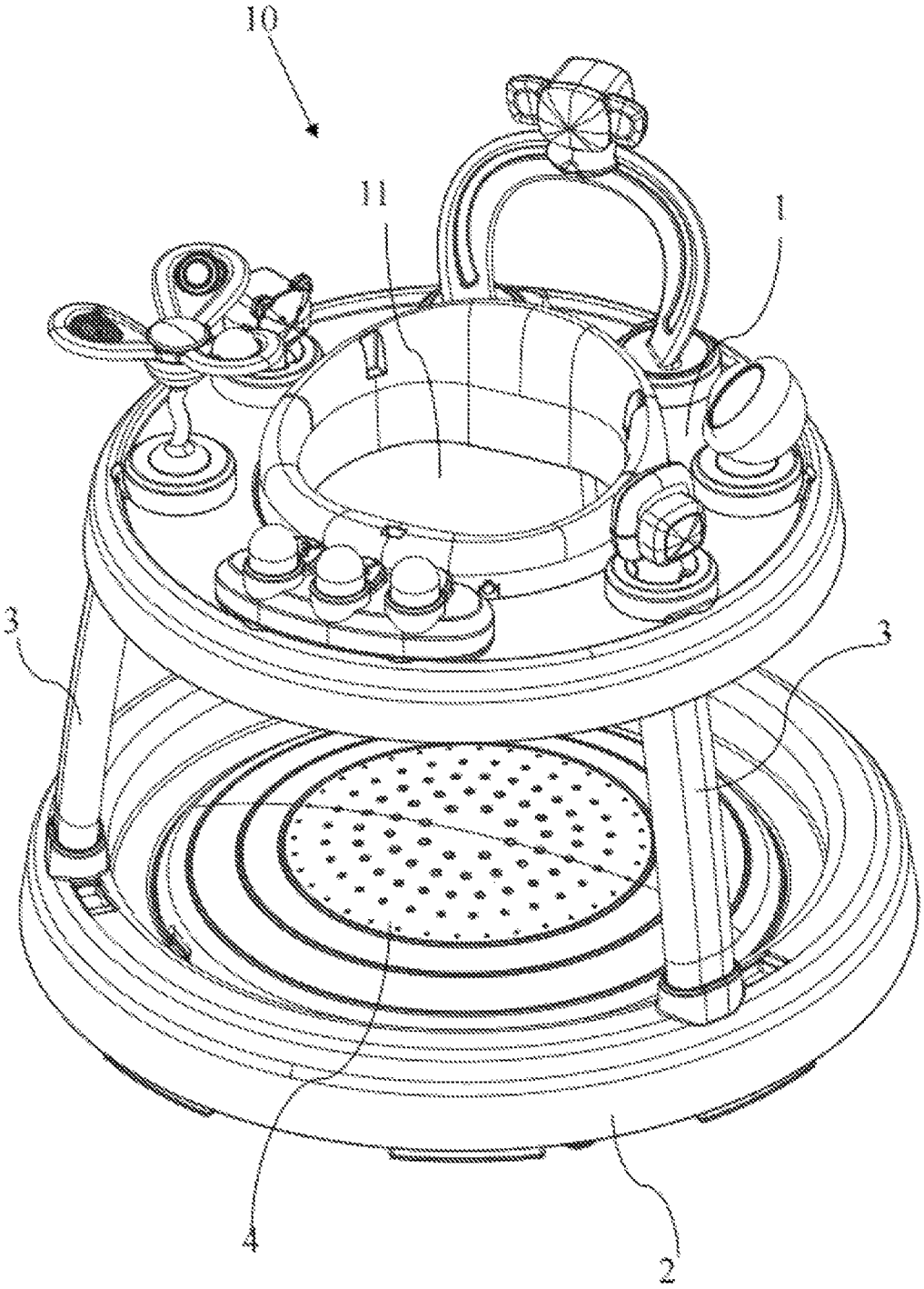
FIG. 1 is a schematic view of an activity center structure for a child according to an embodiment of the present disclosure.

Correspondences between reference numerals and names of members are as follows:

10, activity center structure for a child; 1, activity center frame; 11, central through-hole; 2, support bottom frame; 21, mounting position; 22, mounting groove; 23, sliding slot; 24, communication hole; 25, stop plate; 3, support leg; 31, insertion slot; 32, protrusion; 41, elastic surface; 4, elastic plate; 42, panel frame; 421, frame bottom plate; 422, frame wall; 5, roller; 6, locking member; 61, groove; 62, shifting recess; 63, operation block; 7, elastic reset member.

DETAILED DESCRIPTION OF THE EMBODIMENTS

Specific embodiments of the present disclosure will be further described below in conjunction with the accompanying drawings.

It is easy to understand that, according to the technical solutions of the present disclosure, a person skilled in the art can substitute various structural modes and implementation modes without changing the essential spirit of the present disclosure. Therefore, the following specific embodiments and accompanying drawings are only exemplary descriptions of the technical solutions of the present disclosure, and should not be regarded as the whole of the present disclosure or as a restriction or limitation on the technical solutions of the present disclosure.

Orientation terms such as upper, lower, left, right, before, after, front, rear, top, bottom, and the like mentioned or possibly mentioned in this specification are defined relative to the structures shown in the drawings, and the terms are relative concepts. Thus, the terms may be changed accordingly based on different positions and different use states. These and other orientation terms should therefore not be interpreted as restrictive.

As shown in FIG. 1 to FIG. 4, an activity center structure 10 for a child according to an embodiment of the present disclosure includes an activity center frame 1, a support bottom frame 2, a support leg 3, and an elastic surface 4 having elasticity.

The activity center frame 1 is located above the support bottom frame 2, and provided with a seat pocket (not shown in the drawings) for placing the child at a middle part of the activity center frame 1. The support leg 3 is connected between the activity center frame 1 and the support bottom frame 2.

The support bottom frame 2 has a mounting position 21 where the support bottom frame 2 is hollow. The mounting position 21 at least corresponds to a position where the seat pocket is located. The elastic surface 4 is mounted at the mounting position 21 to allow the child placed in the seat pocket to step on the elastic surface 4.

The activity center structure 10 for the child is an article for children, which has characteristics of good stability and high safety.

The activity center structure 10 for the child includes the activity center frame 1, the support bottom frame 2, the support leg 3, and the elastic surface 4.

The activity center frame 1 is located above the support bottom frame 2. The support leg 3 has an end connected to the activity center frame 1 and another end connected to the support bottom frame 2.

In another exemplary embodiment of the present disclosure, the activity center frame 1 is annular and has a central through-hole 11 that penetrates the activity center frame 1. During use, a child is positioned in the central through-hole 11, thereby limiting a movement range of the child. Various toys can be arranged on the activity center frame 1 for children to play, such as toy bells, toy horns, toy windmills, etc., thereby enriching functions of the activity center structure 10 for the child and improving the fun of children playing.

In another exemplary embodiment of the present disclosure, a plurality of support legs 3 are connected between the activity center frame 1 and the support bottom frame 2. A distance between two adjacent support legs 3 is equal. In this embodiment, three support legs 3 are connected between the activity center frame 1 and the support bottom frame 2.

The seat pocket is arranged at the activity center frame 1, and an upper end of the seat pocket is connected to a hole wall of the central through-hole 11 of the activity center frame 1. The child can be placed on the seat pocket and supported by the seat pocket.

In another exemplary embodiment of the present disclosure, the seat pocket is made of mesh cloth, which is breathable to be beneficial for the child to dissipate heat.

The support bottom frame 2 is used to be placed on the ground to support the entire activity center structure 10 for the child. The support bottom frame 2 has the mounting position 21, and the elastic surface 4 is mounted at the mounting position 21. The mounting position 21 may be a through-hole penetrating in an up and down direction or a receiving groove. The mounting position 21 is located below the seat pocket. In the up and down direction, a projection of the mounting position 21 at least partially overlaps a projection of the seat pocket.

In another exemplary embodiment of the present disclosure, moving wheels are mounted at a bottom of the support bottom frame 2 to facilitate movement.

The elastic surface 4 is elastic and can deform under compression. The elastic surface 4 mounted at the mounting position 21 is blocked by the support bottom frame 2 and can only expand and contract in the up and down direction.

The activity center structure 10 for the child is placed on the ground during use. The child can stand on the elastic surface 4 through the central through-hole 11. When the child steps on the elastic surface 4, the elastic surface 4 is forced to be stretched downward. When the child does not step on the elastic surface 4, the elastic surface 4 retracts upward.

In this way, the entire elastic surface 4 can only deform in the up and down direction under an action of the support bottom frame 2, thereby ensuring the stability of the entire elastic surface 4 in the horizontal direction, preventing side rollover when the child moves and improving safety. The support legs 3 strengthen structural strength of the support bottom frame 2. Therefore, the support bottom frame 2 can better restrict the elastic surface 4 and ensure the stability of the elastic surface 4 in the horizontal direction.

In another exemplary embodiment of the present disclosure, the activity center frame 1, the support bottom frame 2 and the support leg 3 are all plastic products, thereby reducing production materials and saving costs.

Figure 2:
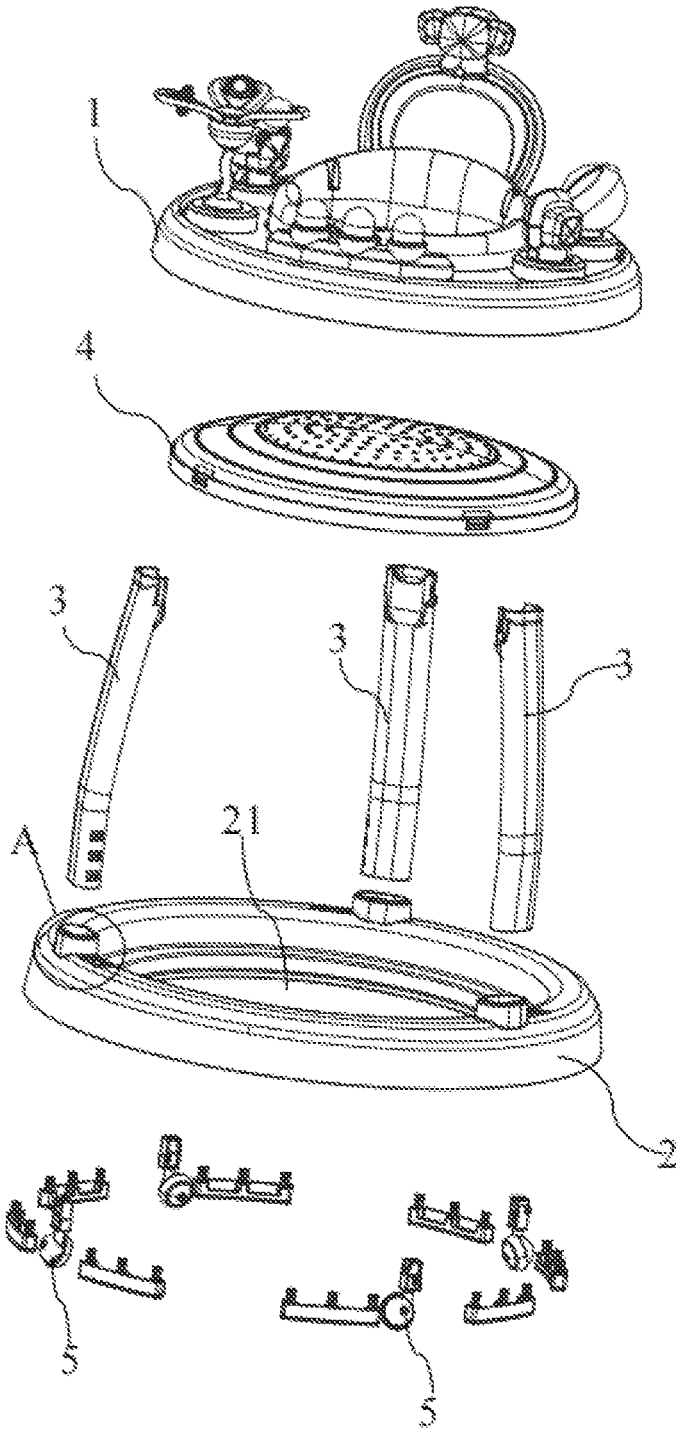
FIG. 2 is an exploded view of an activity center structure for a child according to an embodiment of the present disclosure.
Figure 3:
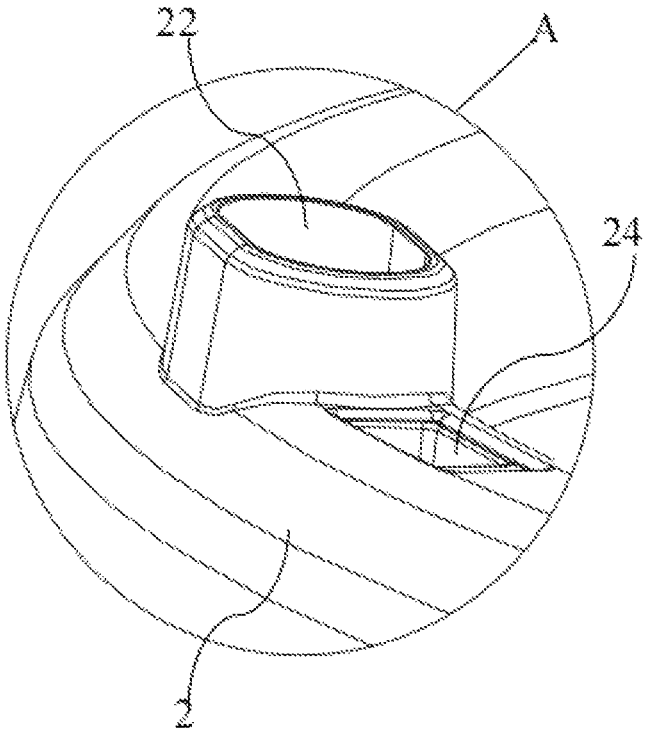
FIG. 3 is a schematic view of a part A in FIG. 2.
Figure 4:
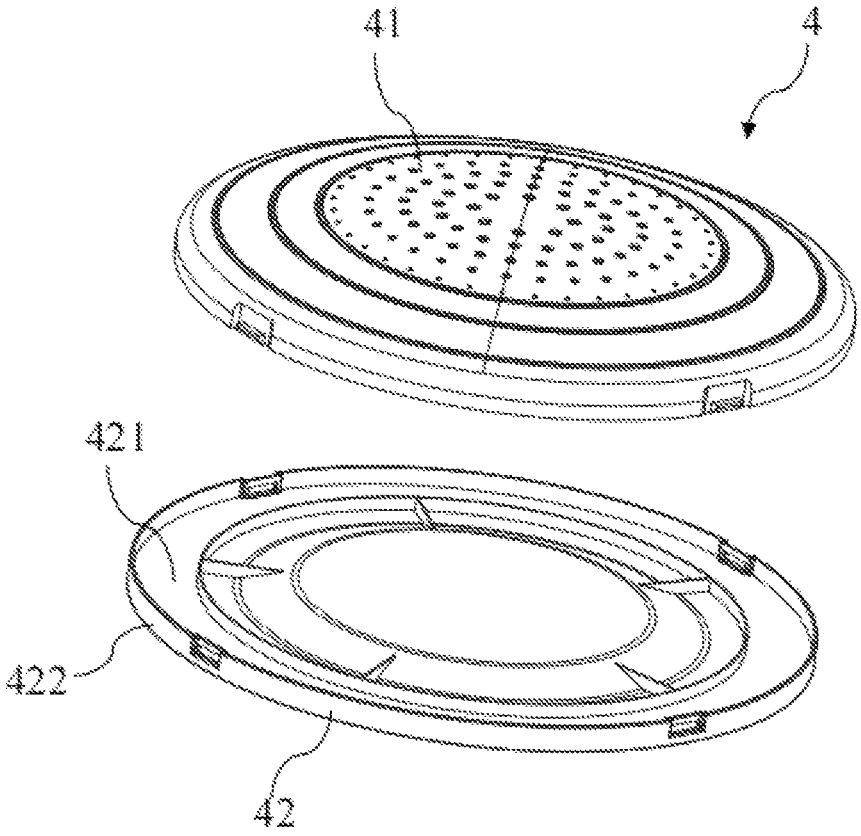
FIG. 4 is an exploded view of an elastic surface in an embodiment of the present disclosure.

In one embodiment, as shown in FIG. 2 to FIG. 4, the elastic surface 4 includes a panel frame 42 and an elastic plate 41. The panel frame 42 is connected to the mounting position 21, and the elastic plate 41 is connected to the panel frame 42.

In an exemplary embodiment of the present disclosure, the elastic surface 4 is composed of the panel frame 42 and the elastic plate 41. The panel frame 42 is mounted at the mounting position 21 and configured to mount the elastic plate 41. The panel frame 42 has a mounting region opened towards the elastic surface 4. The elastic plate 41 is a deformation portion of the elastic surface 4, and the elastic surface 4 is mounted in the mounting region. The panel frame 42 limits a position of the elastic plate 41, further improving the stability of the elastic plate 41 in the horizontal direction. Moreover, when the elastic plate 41 or the panel frame 42 is damaged, the entire elastic surface 4 does not need to be replaced, and the loss is reduced.

In another exemplary embodiment of the present disclosure, the elastic plate 41 may be made of rubber, resin, or textile cloth and so on, or may be made of other materials as long as the elastic plate 41 is elastic.

In another exemplary embodiment of the present disclosure, an upper surface of the elastic plate 41 has a pattern groove, which not only increases an aesthetic appearance of the elastic plate 41, but also increases a friction force of the elastic plate 41.

In one embodiment, as shown in FIG. 4, the elastic plate 41 is detachably connected to the panel frame 42. The elastic plate 41 and the panel frame 42 may be fixed to or separated from each other, which are easy to install and replace maintenance.

In an exemplary embodiment of the present disclosure, the panel frame 42 has a frame wall 422, and the frame wall 422 has an engagement groove. A side surface of the elastic plate 41 is provided with a engagement hook. When the panel frame 42 is connected to the elastic plate 41, the engagement hook is engaged in the engagement groove to enable the elastic plate 41 to be fixed to the panel frame 42.

In another exemplary embodiment of the present disclosure, the panel frame 42 and the elastic plate 41 may be detachably connected by other structures. For example, the engagement hook may be arranged at the frame wall 422, and the elastic plate 41 may have the engagement groove, as long as the panel frame 42 can be connected to or separated from the elastic plate 41.

In one embodiment, as shown in FIG. 2 and FIG. 4, the panel frame 42 includes a frame bottom plate 421, and the elastic plate 41 is arranged above and spaced apart from the frame bottom plate 421. A bottom of the frame bottom plate 421 is connected to rollers 5.

In an exemplary embodiment of the present disclosure, the panel frame 42 includes the frame wall 422 and the frame bottom plate 421, and the frame wall 422 is connected to the frame bottom plate 421 to form a mounting region. The elastic plate 41 is mounted at the frame wall 422 and suspended above the frame bottom plate 421, thereby forming a deformation space for the elastic plate 41.

The rollers 5 are rotatably connected to the bottom of the frame bottom plate 421, and the rollers 5 are in contact with the ground, reducing friction between the rollers 5 and the ground, thus facilitating movement.

In another exemplary embodiment of the present disclosure, the rollers 5 are universal wheels, which have high degrees of freedom and are convenient to move in all directions.

In one embodiment, as shown in FIG. 2 to FIG. 3 and FIG. 5 to FIG. 7, the support leg 3 is slidably connected to the support bottom frame 2 in a longitudinal direction, and the support bottom frame 2 is connected to a locking member 6 that is slidable in a transverse direction. The support leg 3 has a plurality of insertion slots 31 arranged at intervals and configured to be engaged with the locking member 6. The locking member 6 is inserted into one of the plurality of insertion slots 31 when the support leg 3 is locked by the locking member 6.

In an exemplary embodiment of the present disclosure, the support bottom frame 2 has a mounting groove 22 opened toward the support leg 3. The support leg 3 is inserted into the mounting groove 22 and is slidable in the mounting groove 22 in the longitudinal direction. It should be noted that the longitudinal direction is the up and down direction, that is, a direction in which the support bottom frame 2 faces towards the activity center frame 1 and a direction in which the activity center frame 1 faces towards the support bottom frame 2.

In another exemplary embodiment of the present disclosure, the support leg 3 is in clearance fit with the mounting groove 22. Alternatively, a slide rail is provided in the mounting groove 22, and the support leg 3 is connected to the slide rail, thus realizing a sliding connection between the support leg 3 and the mounting groove 22.

The support bottom frame 2 further internally has a sliding slot 23 in communication with the mounting groove 22. The sliding slot 23 internally has the locking member 6. The locking member 6 can be slidably connected in the sliding slot 23 in the transverse direction. It should be noted that the transverse direction is a left-right direction, that is, a direction in which the locking member 6 faces towards the support leg 3 and a direction in which the support leg 3 faces towards the locking member 6.

The plurality of insertion slots 31 is arranged at intervals on the support leg 3, and distances between any two adjacent insertion slots 31 are equal. The locking member 6 can be inserted into one of the plurality of insertion slots 31 to lock the support leg 3, allowing the support leg 3 to remain fixed. In this way, the support leg 3 enables a height of the activity center frame 1 to be adjusted to suit children of different heights.

When the height of support leg 3 is adjusted, the locking member 6 slides to a unlocked position first, and the locking member 6 is separated from the insertion slot 31. Then the support leg 3 slides to an appropriate height to allow the corresponding insertion slot 31 align with the sliding slot 23. Then the locking member 6 slides to a locking position, and the locking member 6 is inserted into the insertion slot 31. After the locking member 6 is inserted into the insertion slot 31 to block the support leg 3 from moving up and down, thus the support leg 3 is fixed.

Figure 5:
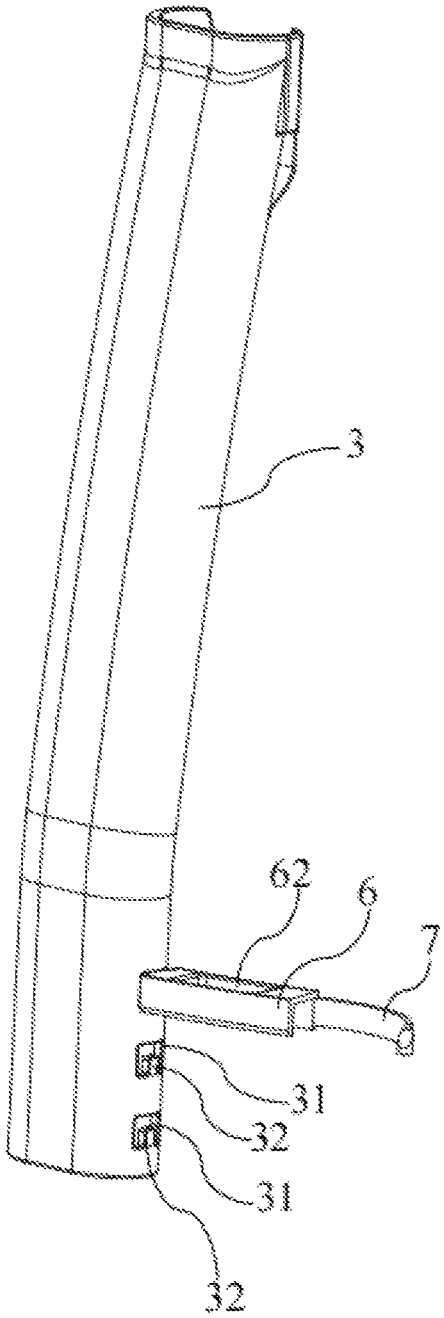
FIG. 5 is a schematic view of a support leg and a locking member in an embodiment of the present disclosure.
Figure 6:
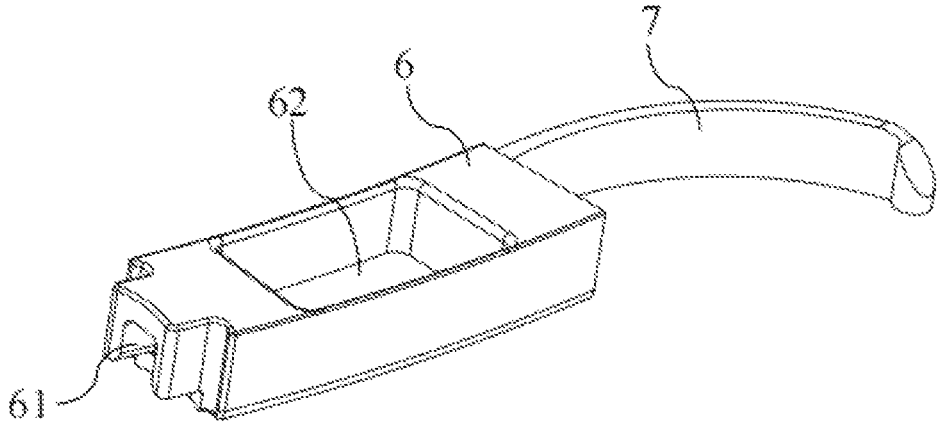
FIG. 6 is a schematic view of a locking member in an embodiment of the present disclosure.

In one embodiment, as shown in FIG. 5 and FIG. 6, each of the plurality of insertion slots 31 internally has a protrusion 32, and the locking member 6 has a groove 61 opened towards the protrusion 32. The protrusion 32 is positioned in the groove 61 when the locking member 6 is inserted into the insertion slot 31.

In an exemplary embodiment of the present disclosure, the protrusion 32 is arranged in the insertion slot 31, which enables that the insertion slot 31 has a gate shape. An end of the locking member 6 facing towards the support leg 3 has the groove 61. When the locking member 6 is inserted into the insertion slot 31, the protrusion 32 is positioned in the groove 61. In this way, when the locking member 6 is engaged with the insertion slot 31, a gap of the locking member 6 in the insertion slot 31 is reduced, which enables that the movement of the support leg 3 can be better restricted. Moreover, the protrusion 32 also increases the structural strength of the support leg 3, which allows the support leg to be less susceptible to damage.

Figure 7:
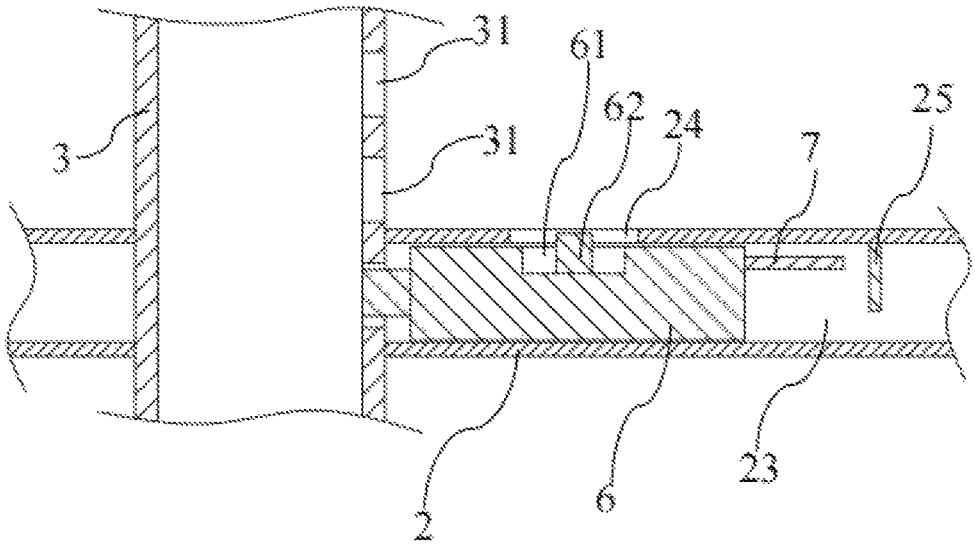
FIG. 7 is a schematic view of a support bottom frame, a support leg and a locking member in an embodiment of the present disclosure.

In one embodiment, as shown in FIG. 5 to FIG. 7, the support bottom frame 2 has a communication hole 24. The locking member 6 has a shifting recess 62 configured to operate the locking member 6 to slide. The shifting recess 62 is communication with the communication hole 24.

In an exemplary embodiment of the present disclosure, an upper surface of the locking member 6 has the shifting recess 62 recessed downwardly, and the support bottom frame 2 has the communication hole 24 in communication with the sliding slot 23. The shifting recess 62 is aligned with the communication hole 24. When the locking member 6 is required to be slid, user can shift the shifting recess 62 through the communication hole 24, which is convenient to operate. Moreover, a position of the shifting recess 62 can be observed through the communication hole 24, enabling that the position of the locking member 6 can be easily obtained.

In one embodiment, as shown in FIG. 7, the shifting recess 62 internally has an operation block 63 at least partially located in the communication hole 24. The operation block 63 is slidably connected at the communication hole 24. The operation block 63 extends upward from a bottom of the shifting recess 62. The operation block 63 extends into the communication hole 24 and can slide therein. The user can slide the locking member 6 by holding the operation block 63, which is convenient to operate.

In one embodiment, as shown in FIG. 7, the support bottom frame 2 is provided with a stop plate 25, and an elastic reset member 7 configured to reset the locking member 6 is connected between the locking member 6 and the stop plate 25. The elastic reset member 7 is connected to the locking member 6 and is capable of abutting with the stop plate 25.

In an exemplary embodiment of the present disclosure, the stop plate 25 is arranged in the sliding slot 23, and the stop plate 25 is located at a side of the locking member 6 facing away from the support leg 3. The elastic reset member 7 is connected to the end of the locking member 6 facing away from the support leg 3. The elastic reset member 7 is able to be extended and compressed. When an external force is applied to place the locking member 6 in the unlocked position, the elastic reset member 7 abuts with the stop plate 25, and the elastic reset member 7 is compressed to be in a compressed state. When the external force is released, the elastic reset member 7 releases an elastic force and is in an extended state, and then pushes the locking member 6 to move towards the support leg 3. In this way, the operation is more convenient, improving the convenience of operation.

In another exemplary embodiment of the present disclosure, the elastic reset member 7 is a return spring.

In one embodiment, as shown in FIG. 6 and FIG. 7, the elastic reset member 7 is an elastic strip of an arc shape.

In an exemplary embodiment of the present disclosure, the elastic reset member 7 is an elastic strip, and the elastic strip is arc-shaped. When the elastic strip is compressed, a radian of the elastic strip increases, which enables that the elastic strip generates elastic potential energy. In addition, the elastic strip has a first end close to the locking member 6 and a second end facing away form the locking member 6. A width of the first end is greater than a width of the second end, thereby allowing the elastic strip more elastic.

In summary, the present disclosure provides an activity center structure 10 for the child including an activity center frame 1, a support bottom frame 2, a support leg 3, and an elastic surface 4 having elasticity. The activity center frame 1 is located above the support bottom frame 2, and provided with a seat pocket for placing the child at a middle part of the activity center frame 1. The support leg 3 is connected between the activity center frame 1 and the support bottom frame 2. The support bottom frame 2 has a mounting position 21 where the support bottom frame 2 is hollow. The mounting position 21 at least corresponds to a position where the seat pocket is located. The elastic surface 4 is mounted at the mounting position 21. The activity center structure 10 for the child is used for children's activities. When in use, the child steps on the elastic surface 4, and the elastic surface 4 can only deform in the up and down direction under the action of the support bottom frame 2 and the support leg 3. Therefore, the side rollover of the child during play is avoided, the safety is improved, which can protect the health of the child.

The above descriptions are only the principles and preferred embodiments of the present disclosure. It should be noted that for those skilled in the art, several other variations can be made on the basis of the principles of the present disclosure, which should also be regarded as the protection scope of the present disclosure.

What is claimed is:

1. An activity center structure for a child, comprising an activity center frame, a support bottom frame, a support leg, and an elastic surface having elasticity, wherein:

the activity center frame is located above the support bottom frame, and provided with a seat pocket for placing the child at a middle part of the activity center frame;

the support leg is connected between the activity center frame and the support bottom frame;

the support bottom frame has a mounting position where the support bottom frame is hollow, the mounting position at least corresponding to a position where the seat pocket is located, the elastic surface being mounted at the mounting position to allow the child placed in the seat pocket to step on the elastic surface;

the support leg is slidably connected to the support bottom frame in a longitudinal direction;

the support bottom frame is connected to a locking member that is slidable in a transverse direction;

the support leg has a plurality of insertion slots arranged at intervals and configured to be engaged with the locking member;

the locking member is inserted into one of the plurality of insertion slots when the support leg is locked by the locking member;

each of the plurality of insertion slots internally has a protrusion;

the locking member has a groove opened towards the protrusion; and the protrusion is positioned in the groove when the locking member is inserted into the insertion slot.

2. The activity center structure according to claim 1, wherein the elastic surface comprises:

a panel frame connected to the mounting position; and an elastic plate connected to the panel frame.

3. The activity center structure according to claim 2, wherein the elastic plate is detachably connected to the panel frame.

4. The activity center structure according to claim 2, wherein:

the panel frame comprises a frame bottom plate, the elastic plate being arranged above and spaced apart from the frame bottom plate; and a bottom of the frame bottom plate is connected to rollers.

5. The activity center structure according to claim 1, wherein:

the support bottom frame has a communication hole; and the locking member has a shifting recess configured to operate the locking member to slide, the shifting recess being in communication with the communication hole.

6. The activity center structure according to claim 5, wherein the shifting recess internally has an operation block at least partially located in the communication hole, the operation block being slidably connected at the communication hole.

7. The activity center structure according to claim 1, wherein:

the support bottom frame is provided with a stop plate;

an elastic reset member configured to reset the locking member is connected between the locking member and the stop plate; and the elastic reset member is connected to the locking member and is capable of abutting with the stop plate.

8. The activity center structure according to claim 7, wherein the elastic reset member is an elastic strip of an arc shape.

* * * * *